US006621995B1

(12) United States Patent
Rejewski et al.

(10) Patent No.: US 6,621,995 B1
(45) Date of Patent: Sep. 16, 2003

(54) IMAGE-FORMING MACHINE HAVING A DEVELOPMENT STATION WITH A DUSTING CONTROL SYSTEM

(75) Inventors: Robert S. Rejewski, Brockport, NY (US); Richard G. Allen, Rochester, NY (US)

(73) Assignee: Heidelberger Druckmaschinen AG (DE)

( * ) Notice: Subject to any disclaimer, the term of this patent is extended or adjusted under 35 U.S.C. 154(b) by 0 days.

(21) Appl. No.: 10/096,170

(22) Filed: Mar. 11, 2002

(51) Int. Cl.[7] ..... G03G 15/08; G03G 21/00
(52) U.S. Cl. ..... 399/92; 399/98
(58) Field of Search ..... 399/92, 93, 98, 399/103

(56) References Cited

U.S. PATENT DOCUMENTS 3,685,485 A * 8/1972 Kutsuwada et al. ..... 399/93

FOREIGN PATENT DOCUMENTS

JP 3-127087 A * 5/1991
JP 11-327295 A * 11/1999

OTHER PUBLICATIONS

JP11327295A—Machine translation from Japanese Patent Office website, Nov. 1999.

* cited by examiner

*Primary Examiner*—Joan Pendegrass

(57) ABSTRACT

An image-forming machine has a development station with a dusting control system that generates a flow barrier adjacent to a development region.

19 Claims, 7 Drawing Sheets

IMAGE-FORMING MACHINE HAVING A DEVELOPMENT STATION WITH A DUSTING CONTROL SYSTEM

FIELD

This invention generally relates to image-forming machines having a development station. More particularly, this invention relates to image-forming machines having systems to remove or control airborne toner and carrier from a development station.

BACKGROUND

Image-forming machines usually transfer images onto paper or other medium using an electrophotographic process. An image-forming machine typically has a photoconductor, one or more chargers, an exposure machine, a development station, a fuser station, and a cleaning station. The image-forming machine also may have a logic control unit (LCU) or other microprocessor, a graphic user interface, and other components.

The photoconductor is selectively charged and optically exposed to form an electrostatic latent image on the surface. The development station deposits toner onto the photoconductor surface. The toner is charged, thus adhering to the photoconductor surface in areas corresponding to the electrostatic latent image. The toner image is transferred onto a sheet of paper or other medium. In the fuser station, the sheet is heated causing the toner to fix or adhere to the paper or other medium. The photoconductor is refreshed, cleaned to remove residual toner and charge, and then is ready to make another image. The sheet exits the image-forming equipment.

At the development station, toner is attracted to the photoconductor under the influence of an electric field in a development region between the development station and the photoconductor. The development station stores and mixes a developer, which may be mono-component or bi-component. A mono-component developer comprises toner. A bi-component developer comprises a mixture of toner and a carrier. Toner is the marking material in an image-forming machine and usually comprises a polymer, a pigment, and a charging agent. Carrier is a transport medium and usually comprises magnetic particles, which are typically made of iron or an ironbased material.

The mixing of a mono-component developer triboelectrically charges the toner. The electrostatic-charged toner is transported to the development region. The electric field in the development region lifts the toner slightly from the development station toward the photoconductor for attachment onto the surface of the photoconductor.

The mixing of a bi-component developer triboelectrically charges the toner and carrier. The electrostatic-charged toner adheres to the opposite electrostatic-charged carrier. The carrier transports the toner to the development region. The electric field in the development region releases the toner from the carrier for attachment onto the on the surface of the photoconductor.

In the development region, the toner turns the electrostatic latent image on the photoconductor into a visible image. Portions of the photoconductor surface having the electrostatic latent image attract the toner. Portions on the photoconductor surface not having the electrostatic latent image repulse the toner.

The unused toner from a mono-component or bi-component developer usually returns to the development station for mixing with additional toner and reuse in the image-forming process. However, "dusting" occurs often in which the development station emits airborne toner or airborne toner and carrier into the image forming machine. Airborne toner and carrier represent a loss of material and can adversely affect other subsystems. The migration of airborne toner and carrier throughout the image-forming machine may cause machine errors and image quality artifacts. The airborne toner may accumulate and form "toner stacks" on various components within the image-forming machine. The toner stacks often fall onto portions of the electrophotographic process such as the development roller prior to the development region, the photoconductor, or the sheet or other medium prior to the fusing operation. The toner from the toner stack may cause a comet-shaped smudge or other artifact on the sheet. The toner and carrier also may retain an electrostatic charge and thereby are attracted to components such as the chargers. The build-up of toner on a charger often causes a charger fault or arcing.

Dusting also may adversely affect the development operation in image-forming machines having multiple development stations such as a black-pigment development station and a color-pigment development station. Dusting from each development station may adversely affect the development process in the other development stations. If similarly charged, the airborne toner from one development station may adhere to the photoconductor in place of the toner from another development station. The blending of toner from different development stations also adversely affects the toner properties and subsequently the image quality. If oppositely charged, the airborne toner may blend with the toner from the other development station and may then be attracted to the non-image areas producing a background or fog in the image.

Some image-forming machines implement one or more approaches to remove or otherwise control the airborne toner and carrier. A vacuum pump, fan, or other air movement device may be used to remove and filter the airborne toner from the air within the image-forming machine. Smaller vacuum pumps may be used to remove toner stacks or other build-up of toner in the image-forming machine. Some image-forming machines have a vacuum or electrostatic tube with several openings for applying a vacuum or an electrostatic charge along the trailing edge of the development station. These trailing edge openings collect airborne toner and carrier exiting along the trailing edge. In other approaches, the development region may be physically enclosed. The image-forming machine may have a membrane between the development station and photoconductor at the lead edge of the development station. This lead edge membrane may interfere with the surface of the photoconductor and the electrostatic latent image. The lead edge membrane may need to be removed when the image-forming machine has multiple development stations because the lead edge membrane in a subsequent development station interfere with the toner deposited by a previous development station.

SUMMARY

This invention provides a dusting control system for a development station in an image-forming machine. The dusting control system generates a flow barrier adjacent to a development region for the development station.

In one aspect, an image-forming machine has a photoconductor operatively connected to one or more chargers, an exposure machine, and a development station. The chargers electrostatically charge the photoconductor. The exposure machine forms an electrostatic image on the photoconductor. The development station applies toner on the photoconductor within a development region. The development station has a dusting control system that generates a flow barrier adjacent to the development region.

In another aspect, an image-forming machine has a photoconductor operatively connected to a development station. The development station has a dusting control system and a leading edge. The development station applies toner on the photoconductor. The dusting control system generates a flow barrier adjacent to rig at least a portion of the leading edge.

In a further aspect, a development station for an image-forming machine has a dusting control system that spans at least a portion of a leading edge. The dusting control system generates a flow barrier adjacent to a development region.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

DETAILED DESCRIPTION OF THE PREFERRED EMBODIMENTS

Figure 1:
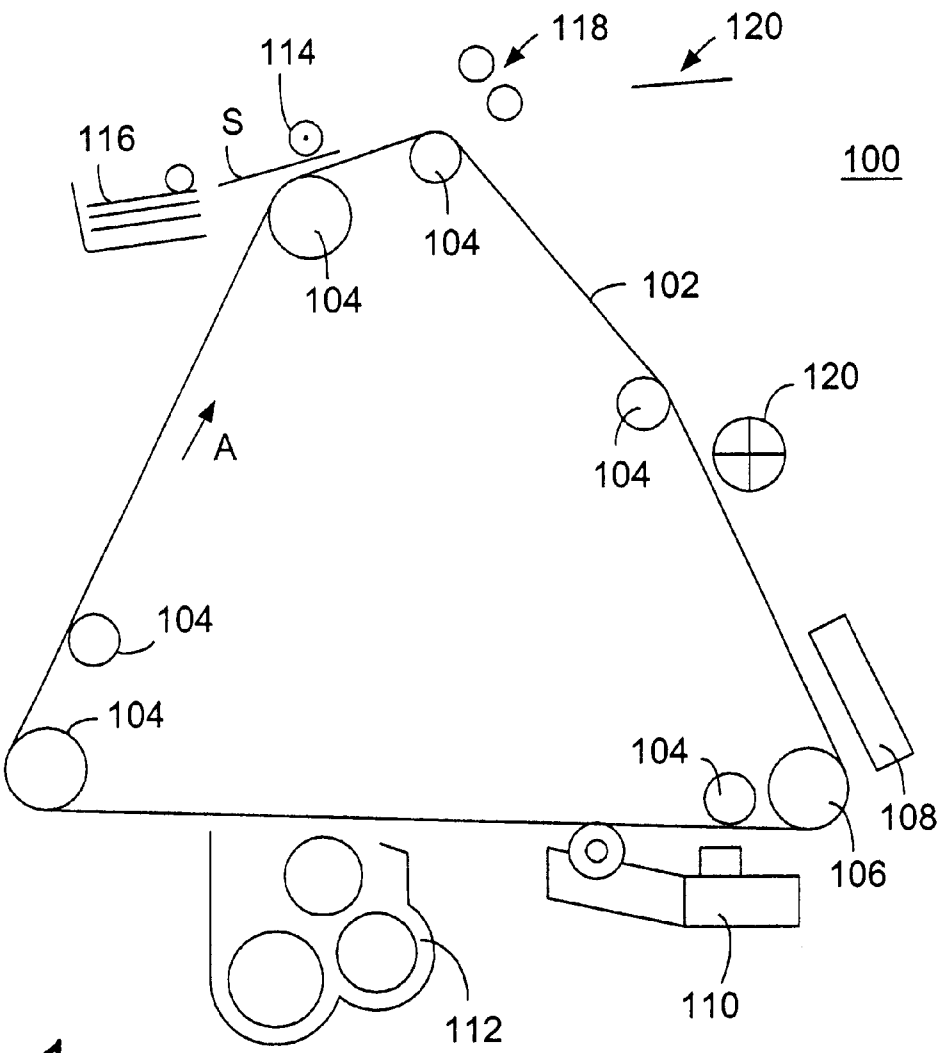
FIG. 1 represents a schematic diagram of an image-forming machine having a development station with a dusting control system according to an embodiment.

FIG. 1 represents a schematic diagram of an image-forming machine 100 having a development station 112 with a dusting control system according to an embodiment. The image-forming machine 100 may be an electrophotographic device such as one of the Digimaster® digital printers manufactured by Heidelberg Digital L.L.C. located in Rochester, N.Y. The image-forming machine 100 may be another eletrophotographic machine, a photocopy machine, a printer device, or the like. The image-forming machine 100 also has a photoconductor 102, a primary charger 108, an exposure machine 110, a transfer charger 114, a fuser station 118, a cleaning station 122, and related equipment such as support rollers 104, a motor driven roller 106, a feeder 116, and a discharge tray 120. The feeder 116 provides sheets of paper or other medium. The image-forming machine 100 also may have a logic and control unit (not shown), a user interface (not shown), an inverter (not shown), a housing (not shown), and the like. The image-forming machine 100 may have other equipment such as an inserter (not shown), a finisher (not shown), and an additional development station (not shown). While particular configurations are shown, other configurations and arrangements may be used including those with additional and fewer components.

In one aspect, the photoconductor 102 is operatively mounted on the support rollers 104 and the motor driven roller 106, which moves the photoconductor 102 in the direction indicated by arrow A. The primary charger 108, the exposure machine 110, the development station 112, the transfer charger 114, the fuser station 118, and the cleaning station 122 are operatively connected adjacent to the photoconductor 102. Operatively connected includes electrical, mechanical, and other connections as well as the spatial positioning with the photoconductor 102 for an electrophotographic process. The feeder 116 is operatively connected to provide a sheet S of paper or other medium to the transfer charger 114. Multiple sheets may be processed in this manner or the like. The photoconductor 102 has a belt and roller-mounted configuration and may have a drum or other suitable configuration. The housing (not shown) supports and protects various components of the image-forming system 100, which may be integrated with or part of the housing.

Figure 2:
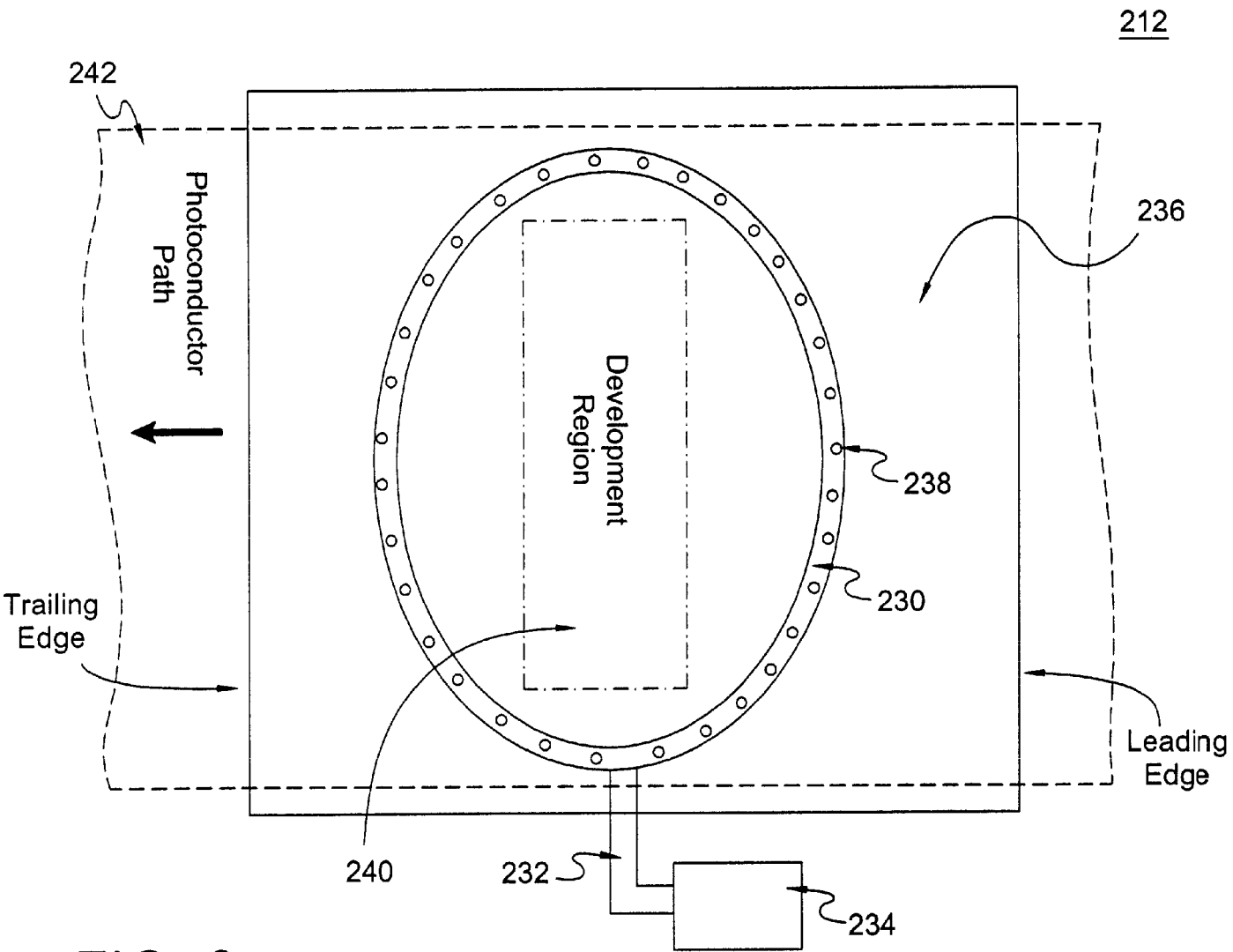
FIG. 2 represents a block diagram of a development station having a dust control system in an image-forming machine according to another embodiment.

FIG. 2 represents a block diagram of a development station 212 having a dust control system in an image-forming machine according to an embodiment. The development station 212 has a dusting control system, which comprises a conduit 230, an extension tube 232, and an airflow device 234. The development station 212 has a leading edge and a trailing edge. The photoconductor passes first over the leading edge, and then passes over the trailing edge. In one aspect, the development station 212 uses a mono-component developer. In an additional aspect, the development station 212 uses a bi-component developer. The development station 212 and the dusting control system may have other configurations and arrangements including those with additional or fewer components.

The conduit 230 is connected to a top surface 236 of the developer station 212. The conduit 230 may protrude from the top surface 236 and may be partially or completely inserted into the top surface 236. The conduit also may be embedded below the top surface 236. The conduit 230 or portions thereof may be formed by other components in the development station 212.

In one aspect, the conduit 230 encircles or surrounds the development region 240 of the development station 212. There may be a gap or space between the conduit 230 and the development region 240. The conduit 230 may have a circular, elliptical, rectangular, or other configuration. In one aspect, the configuration of the conduit 230 is selected in response to the static profile of the development station 212 or the image-forming machine.

The development region 240 essentially comprises the location of an electric field between the development station 212 and a photoconductor (not shown) in the image-forming machine. With a mono-component developer, the electric field lifts the toner slightly from the development station toward the photoconductor for attachment onto the on the surface of the photoconductor. With a bi-component developer, the electric field releases the toner from the carrier for attachment to the photoconductor. The development region 240 may include portions adjacent to the electric field where airborne toner and carrier may be suspended before migration into the development station or elsewhere in the image-forming machine.

In another aspect, the conduit 230 is positioned within a photoconductor path 242 extending across the development station 212. The conduit 230 may be positioned to extend within or beyond the photoconductor path 242. In another aspect the conduit 230 partially encircles or surrounds the development region 240. In a further aspect, the conduit 230 spans a portion or all of the leading edge. In one other aspect, the conduit 230 spans essentially all the leading edge and extends along one or both sides of the development station 212. In one further aspect, the conduit 230 is configured in response to the static profile of the development station 212.

The conduit 230 forms one or more orifices 238 and one or more plenums (not shown). The orifices 238 extend from the outside of the conduit 230 into the plenum, which laterally run along the inside of the conduit 230. In one aspect, the conduit 230 forms the orifices 238 along a side essentially opposite to the development station 212 and facing the photoconductor. The orifices 238 may extend essentially perpendicular to the development station 212. The orifices 238 also may be formed at other locations and at an angle to the development station 212. In one aspect, the orifices 238 have a curvilinear configuration such as a circle, an elipse, an oval, a rectangle with rounded corners, and the like. The orifices may have a combination of configurations and other configurations such as slots parallel or at an angle to the photoconductor path 242.

The orifices 238 have essentially the same cross-section areas and are located an essentially equal distance along the conduit 230. The orifices 238 may have different or variable cross-section areas and may be located at different or variable distances along the conduit 230. The orifices 238 may be aligned, may form a pattern, or may not have any alignment or pattern. In one aspect, the orifices have a circular configuration with a diameter of about 0.01 inches. In another aspect, the orifices have a cross-section area in the range of about 0.03 square inches through about 0.04 square inches. In a further aspect, the total cross-section area of all the orifices 238 is less than about 75 percent of the area of the development region 240. In yet a further aspect, the total cross-section area of all the orifices 238 is in the range of about 50 percent through about 75 percent of the area of the development region 240.

The airflow device 234 is connected to the conduit 230 via the extension tube 232, which has a passageway (not shown) extending from the airflow device 234 to the plenum in the conduit. In one aspect, separate airflow devices are connected through separate extension tubes to each of the plenums in the conduit. In another aspect, there may be one airflow device connected through a chamber or a manifold (not shown) to separate extension tubes, which may have different diameters. The extension tube 232 may be tubular or have another configuration. The extension tube 232 may be part of the conduit 230. The airflow device 234 may be connected to the conduit 230 without the extension tube. The airflow device 234 may be separate or integrated with the development station 212.

The airflow device 234 may be a vacuum pump, an air pump, or other mechanism for moving air into or out of the plenum. A vacuum pump removes air from the plenum thus inducing a vacuum or negative air pressure in relation to air outside the plenum. Airflows into the orifices 238, through the plenum, and out the extension tube. The airflow device 234 may have a filter to collect any toner, carrier, or other particles. An air pump increases air in the plenum thus creating a positive air pressure in relation to air outside the plenum. Airflows into the extension tube, through the plenum, and out of the orifices 238. When the conduit has multiple plenums, a combination of vacuum and air pumps may be used. One or more plenums may have a vacuum or negative air pressure in relation to air outside the plenum. One or more of plenums may have a positive air pressure in relation to air outside the plenum.

Figure 3:
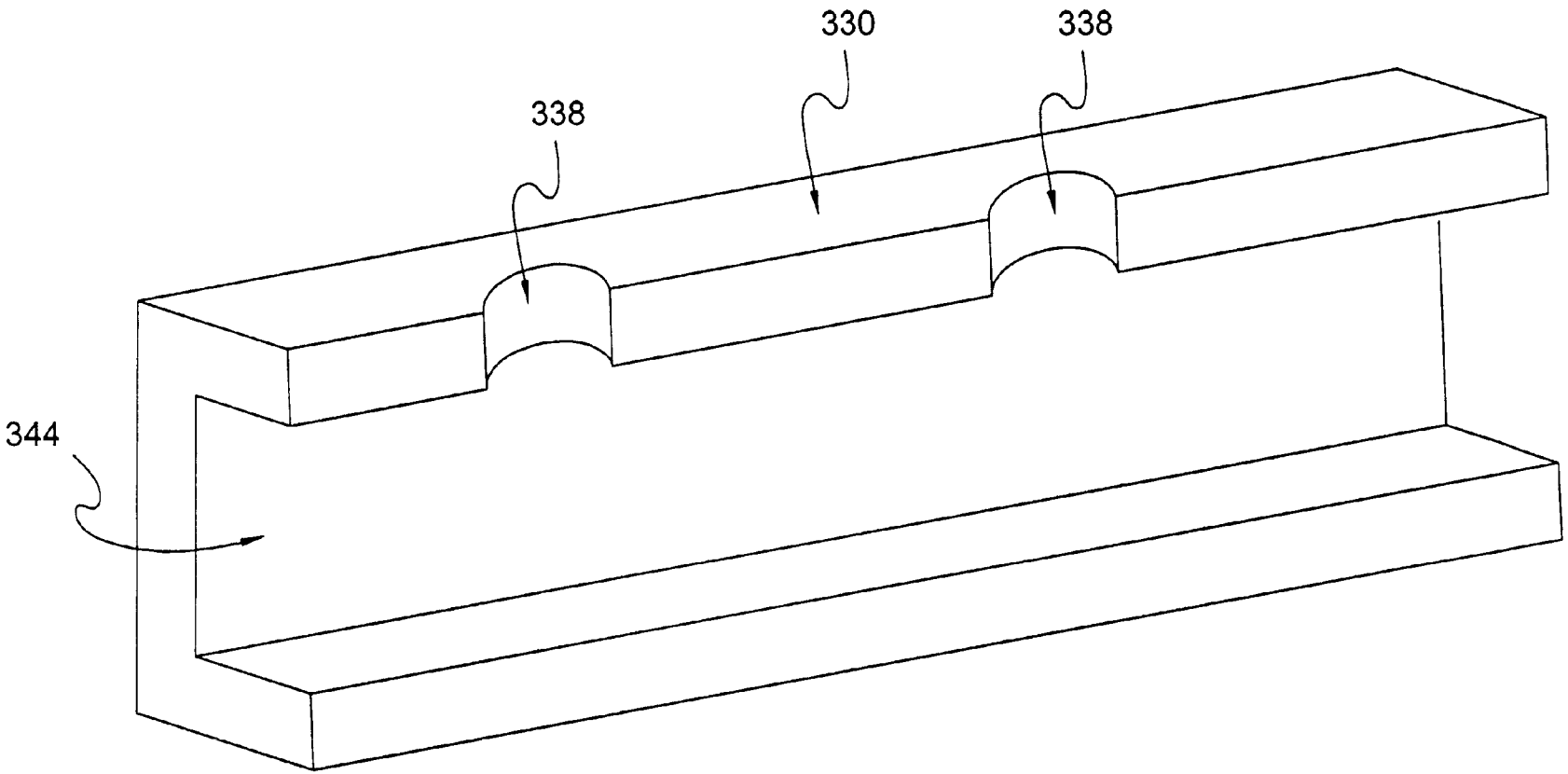
FIG. 3 represents a cross-section view of a conduit for a dusting control system according to an embodiment.

FIG. 3 represents a cross-section view of a conduit 330 for a dusting control system according to an embodiment. The conduit 330 forms one or more orifices 338 and a plenum 344. As previously discussed, an airflow device may pump air into or out of the plenum 344 to create positive or negative air pressure, respectively within the plenum 344. The air pressure may remain constant or may vary during operation of an image-forming machine. Airflows into or out of the orifices 338 in response to the respective negative or positive air pressure.

Figure 4:
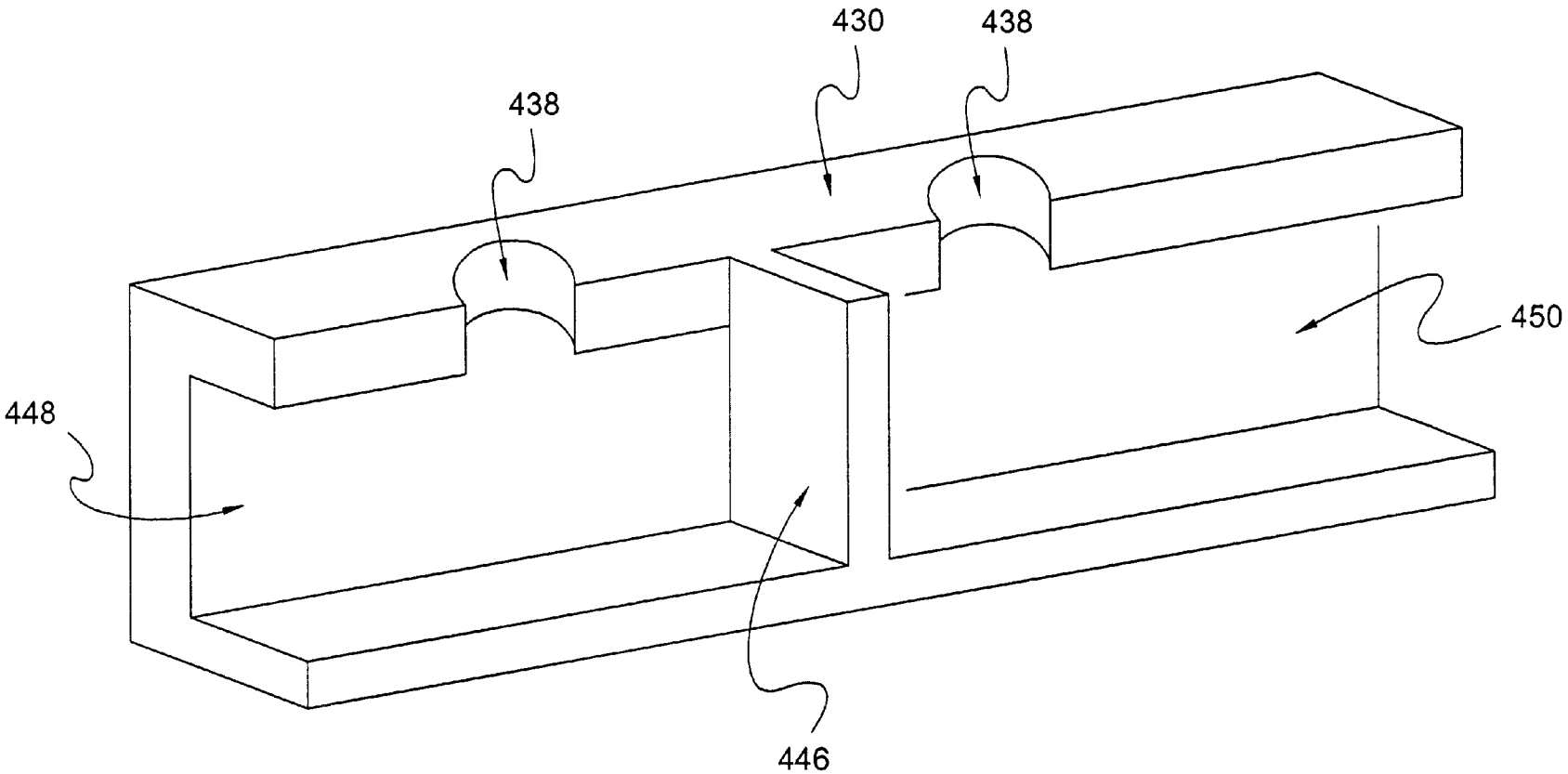
FIG. 4 represents a cross-section view of a conduit for a dusting control system according to another embodiment.

FIG. 4 represents a cross-section view of a conduit 430 for a dusting control system according to another embodiment. The conduit 430 has a first divider 446 and a second divider (not shown). The dividers separate the interior of the conduit 430 into a first plenum 448 and a second plenum 450. The conduit 430 also forms one or more orifices 438 in each of the first and second plenums 448 and 450. Additional plenums may be formed with one or more additional dividers.

One or more airflow devices pump air into or out of the first and second plenums 448 and 450 to create positive or negative air pressure within the plenums 448 and 450 as previously discussed. Each plenum 448 and 450 may have the same air pressure, may have different positive air pressure, and may have different negative air pressure. One plenum may have a positive air pressure and the other plenum may have a negative air pressure. The air pressure in each plenum 448 and 450 may remain constant or may vary during operation of an image-forming machine.

In operation, the dusting control system modifies the static air pressure profile ("static profile") in the development station. The static profile is a representation of the convective airflows throughout the development station and essentially the image-forming machine. The static profile is affected by many factors including the design and location of components, the type and power of existing vacuums and fans, and the location of baffles and other air deflectors in the image-forming machine. Different image-forming machines may have different static profiles. The static profile increases the migration of airborne toner and carrier throughout the image-forming machine. Airborne toner and carrier are transported along the static profile to other areas of the image-forming machine. One effect of the static profile is that the transportation path of airborne toner and carrier is essentially the same during operation of the image-forming machine, increasing the build-up of toner and the formation of toner stacks.

The dusting control system generates a flow barrier adjacent to the development region in the development station. The negative or positive pressure in a plenum causes air to flow into or out of the orifices in a vertical or vertical-like direction from the surface of the development station. This vertical airflow forms the flow barrier that reduces or prevents air from flowing across or horizontal to the orifices. In one aspect, the flow barrier surrounds essentially all the sides of the development region. In another aspect, the flow barrier is adjacent to one or more portions of the development region such as the portions next to the lending and trailing edges. In a further aspect, the flow barrier is configured in response to the static profile of the development station.

The flow barrier extends from the development station to a predetermined distance from the photoconductor. In one aspect, the predetermined distance is greater than about the thickness of the toner image or the electrostatic image on the photoconductor. In a further aspect, a portion of the flow barrier, such as one or both of the sides, has a predetermined distance of about zero and hence extends essentially the entire distance from the development station to the photoconductor. In an additional aspect, a portion of the flow barrier, such as one or both of the leading and trailing edges, extends from the development station to the predetermined distance from the photoconductor.

The flow barrier prevents or eliminates the flow of airborne toner and carrier beyond the development station. When the flow barrier surrounds or is adjacent to all sides of the development region, the airborne toner and carrier remain essentially within the development region. When the flow barrier is adjacent to a portion of the development region, the flow of airborne toner and carrier across that portion of the development region is reduced or eliminated. A flow barrier along the leading or trailing edges of the development station prevents or reduces the flow of airborne toner and carrier across the respective leading a trailing edge. In a further aspect, the flow barrier may remove or collect airborne toner and carrier when a vacuum or negative pressure is used in the plenum to create the flow barrier.

Figure 5:
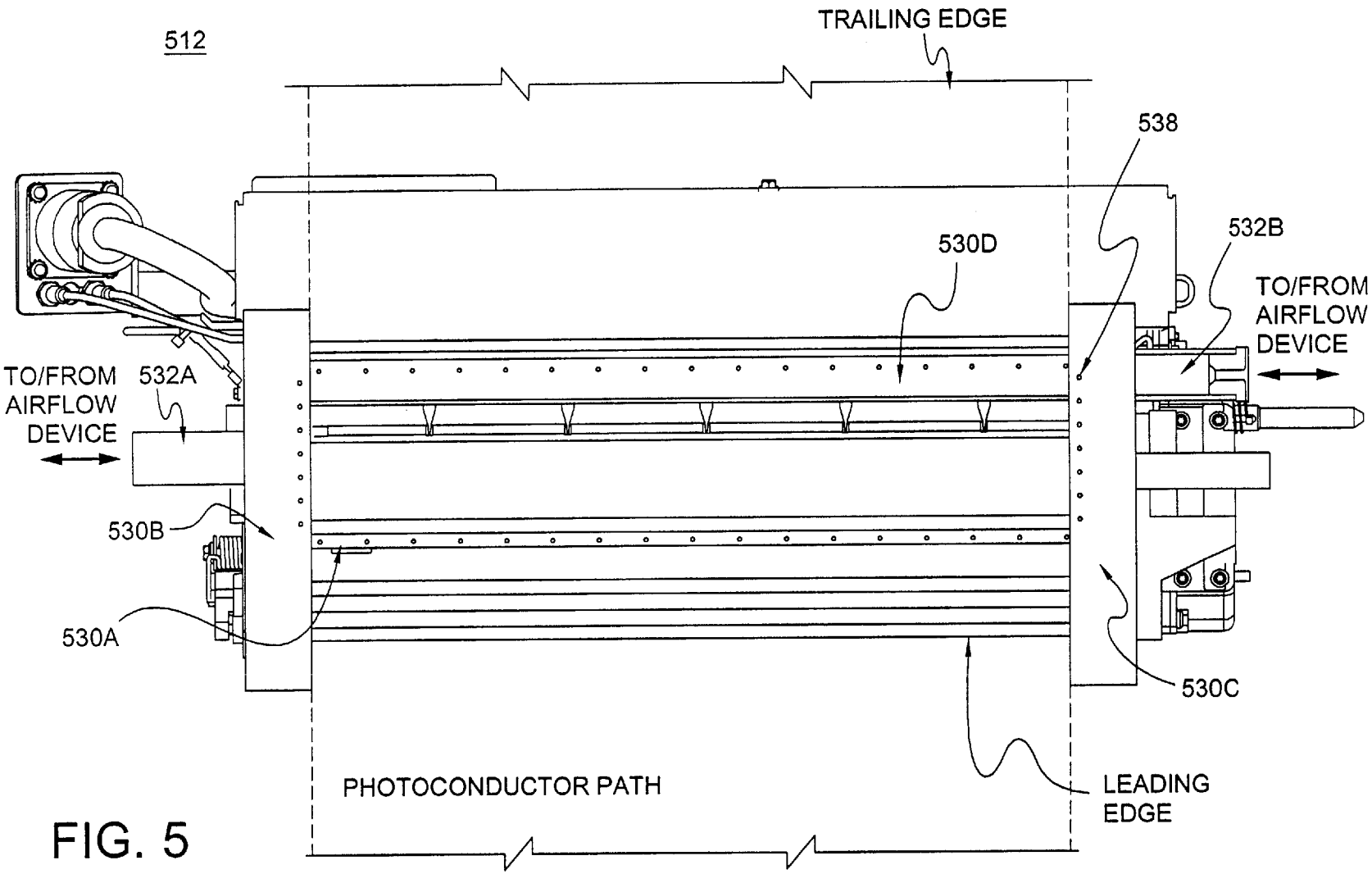
FIG. 5 represents a top view of a development station having a dusting control system according to a further embodiment.

FIG. 5 represents a top view of a development station 512 having a dusting control system according to a further embodiment. The development station 512 may use a mono-component developer or a bi-component developer. The dusting control system includes a first conduit portion 530A, a second conduit portion 530B, and third conduit portion 530C, and a fourth conduit portion 530D. The conduit portions 530A, 530B, 530C, and 530D form an essentially circular configuration surrounding the development region. The dusting control system also includes a first extension tube 532A connected to a first airflow device (not shown) and a second extension tube 532B connected to a second airflow device (not shown). The first conduit portion 530A and the second conduit portion 530B form a first plenum connected to the first airflow device via the first extension tube 532A. The third conduit portion 530C and the fourth conduit portion 530D form a second plenum connected to the second airflow device via the second extension tube 532B. Each conduit portion 530A, 530B, 530C, and 530D has one or more orifices 538 connected to the respective plenums. As previously discussed, the first and second airflow devices create a negative air pressure, a positive air pressure, or a combination of negative and positive air pressures in the plenums to create a flow barrier adjacent to the development region.

Figure 6:
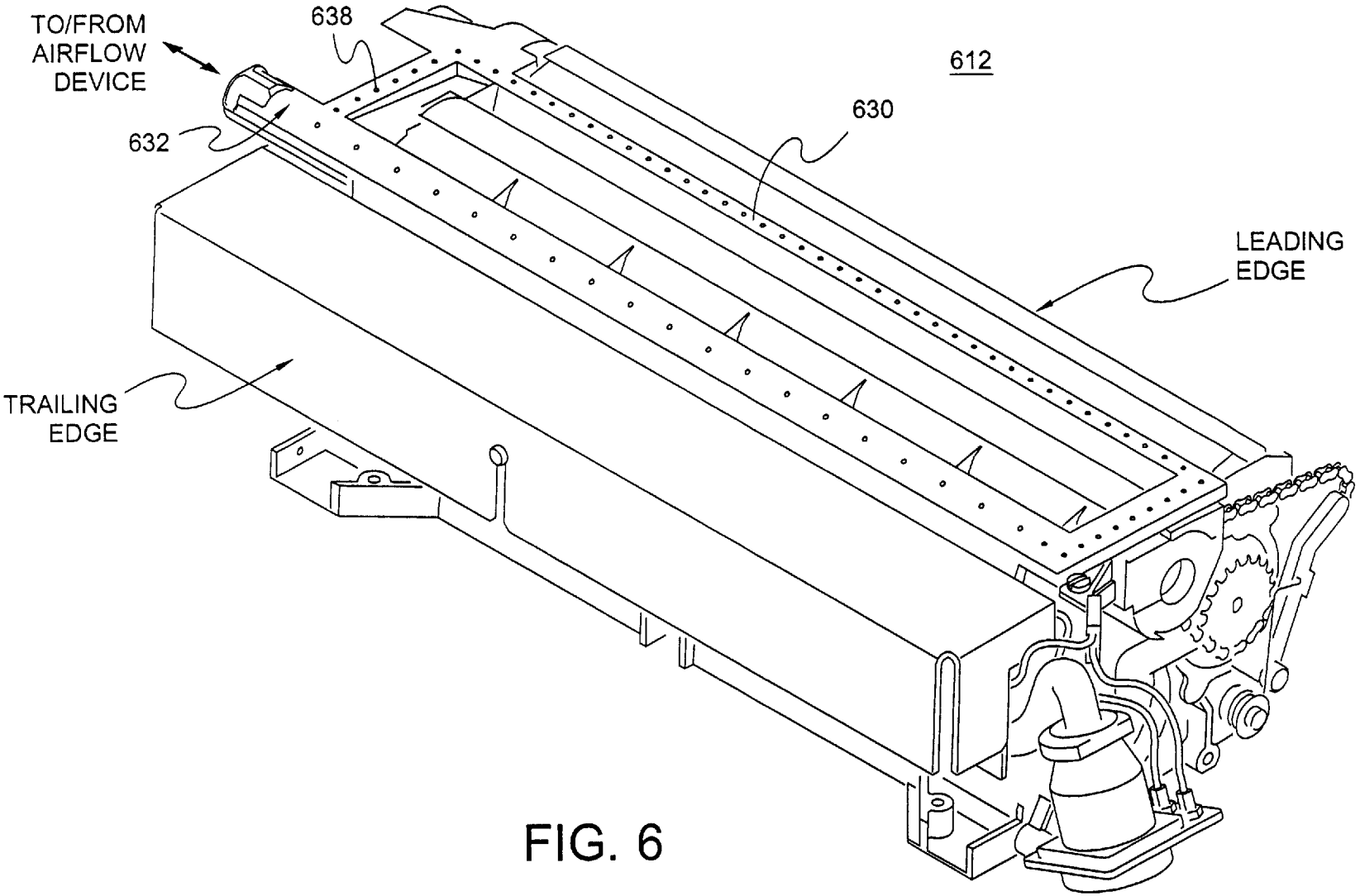
FIG. 6 represents a perspective view of a development station having a dusting control system according to an additional embodiment.

FIG. 6 represents a perspective view of a development station 612 having a dusting control system according to an additional embodiment. The development station 612 may use a mono-component developer or a bi-component developer. The dusting control system includes a conduit 630 forming a plenum and one or more orifices 638. The conduit 630 forms an essentially circular configuration surrounding the development region. The plenum is connected to an airflow device (not shown) via an extension tube 632. As previously discussed, the airflow device creates a negative or positive air pressure in the plenum to create a flow barrier adjacent to the development region.

Figure 7:
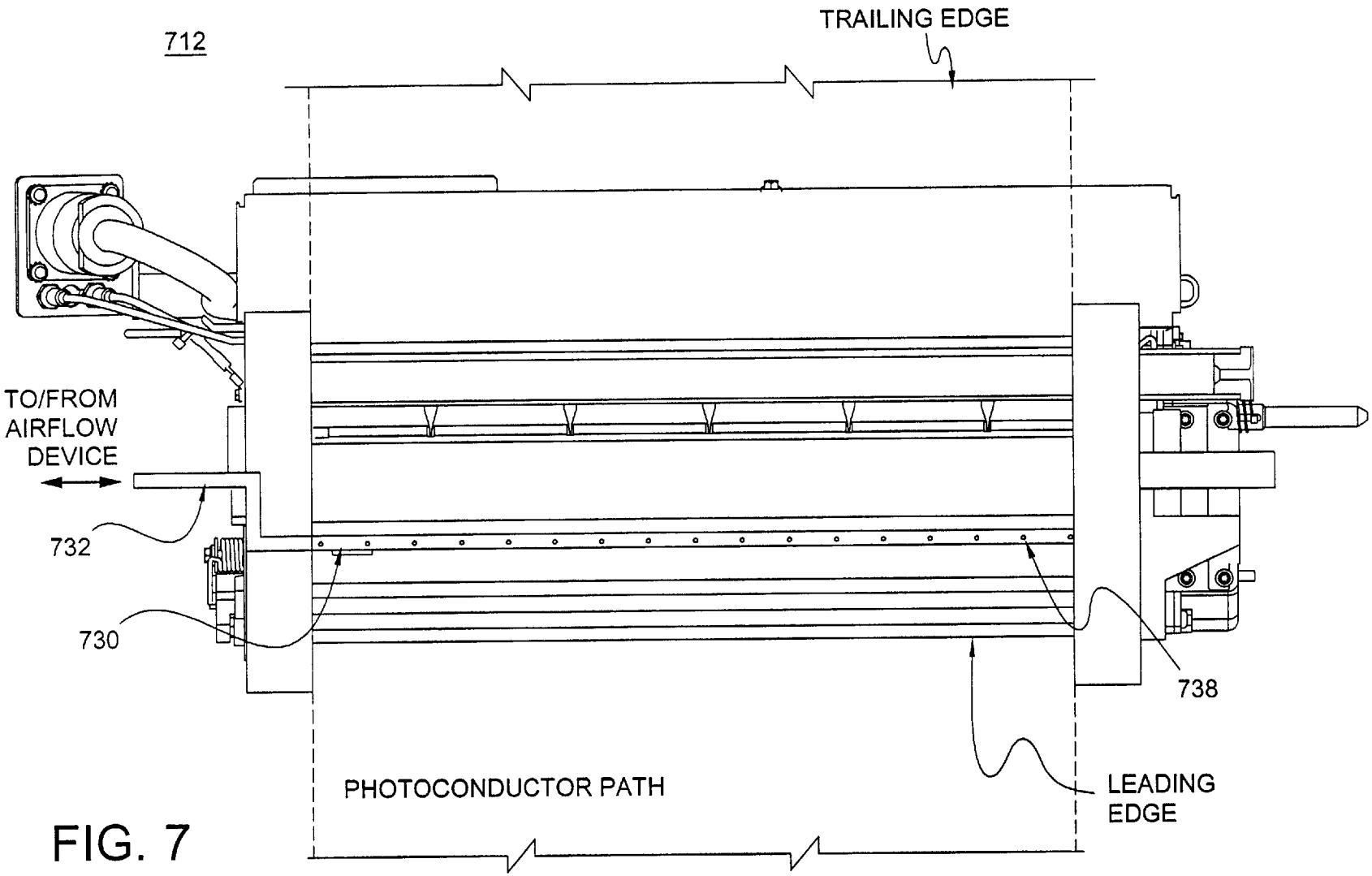
FIG. 7 represents a top view of a development station having a dusting control system according to yet another embodiment.

FIG. 7 represents a top view of a development station 712 having a dusting control system according to yet another embodiment. The development station 712 may use a mono-component developer or a bi-component developer. The dusting control system includes a conduit 730 forming a plenum and one or more orifices 738. The conduit 730 has an essentially straight configuration parallel and adjacent to the leading edge of the development station 712. The plenum is connected to an airflow device (not shown) vie a extension tube 732. As previous discussed, the airflow device creates a negative or positive in the plenum to create a flow barrier adjacent to the development region.

Various embodiments of the invention have been described and illustrated. However, the description and illustrations are by way of example only. Other embodiments and implementations are possible within the scope of this invention and will be apparent to those of ordinary skill in the art. Therefore, the invention is not limited to the specific details, representative embodiments, and illustrated examples in this description. Accordingly, the invention is not to be restricted except in light as necessitated by the accompanying claims and their equivalents.

What is claimed is:

1. An image forming machine comprising:

a photoconductor;

at least one charger operatively connected to the photoconductor, the at least one charger to electrostatically charge the photoconductor;

an exposure machine operatively connected to the photoconductor, the exposure machine to form an electrostatic image on the photoconductor; and a development station operatively connected to the photoconductor, the development station comprising a dusting control system, the development station to apply toner on the photoconductor within a development region, the dusting control system to generate a flow barrier adjacent to the development region;

where the dusting control system comprises a conduit connected to at least one airflow device, the conduit forming at least one orifice and forming at least one plenum;

where the conduit is inserted into a surface of the developer station.

2. An image forming machine comprising:

a photoconductor;

at least one charger operatively connected to the photoconductor, the at least one charger to electrostatically charge the photoconductor;

an exposure machine operatively connected to the photoconductor, the exposure machine to form an electrostatic image on the photoconductor; and a development station operatively connected to the photoconductor, the development station comprising a dusting control system, the development station to apply toner on the photoconductor within a development region, the dusting control system to generate a flow barrier adjacent to the development region;

where the dusting control system comprises a conduit connected to at least one airflow device, the conduit forming at least one orifice and forming at least one plenum;

where the conduit surrounds the development region.

3. An image forming machine comprising:

a photoconductor;

at least one charger operatively connected to the photoconductor, the at least one charger to electrostatically charge the photoconductor;

an exposure machine operatively connected to the photoconductor, the exposure machine to form an electrostatic image on the photoconductor; and a development station operatively connected to the photoconductor, the development station comprising a dusting control system, the development station to apply toner on the photoconductor within a development region, the dusting control system to generate a flow barrier adjacent to the development region;

where the dusting control system comprises a conduit connected to at least one airflow device, the conduit forming at least one orifice and forming at least one plenum;

where the conduit is positioned within a photoconductor path extending across the development station.

4. An image forming machine comprising:

a photoconductor;

at least one charger operatively connected to the photoconductor, the at least one charger to electrostatically charge the photoconductor;

an exposure machine operatively connected to the photoconductor, the exposure machine to form an electrostatic image on the photoconductor; and a development station operatively connected to the photoconductor, the development station comprising a dusting control system, the development station to apply toner on the photoconductor within a development region, the dusting control system to generate a flow barrier adjacent to the development region;

where the dusting control system comprises a conduit connected to at least one airflow device, the conduit forming at least one orifice and forming at least one plenum;

where the conduit has a configuration responsive to a static profile of the development station.

5. An image forming machine comprising:

a photoconductor;

at least one charger operatively connected to the photoconductor, the at least one charger to electrostatically charge the photoconductor;

an exposure machine operatively connected to the photoconductor, the exposure machine to form an electrostatic image on the photoconductor; and a development station operatively connected to the photoconductor, the development station comprising a dusting control system, the development station to apply toner on the photoconductor within a development region, the dusting control system to generate a flow barrier adjacent to the development region;

where the dusting control system comprises a conduit connected to at least one airflow device, the conduit forming at least one orifice and forming at least one plenum;

where the conduit spans at least a portion of a leading edge on the development station.

6. An image forming machine comprising:

a photoconductor;

at least one charger operatively connected to the photoconductor, the at least one charger to electrostatically charge the photoconductor;

an exposure machine operatively connected to the photoconductor, the exposure machine to form an electrostatic image on the photoconductor; and a development station operatively connected to the photoconductor, the development station comprising a dusting control system, the development station to apply toner on the photoconductor within a development region, the dusting control system to generate a flow barrier adjacent to the development region;

where the dusting control system comprises a conduit connected to at least one airflow device, the conduit forming at least one orifice and forming at least one plenum;

where the at least one orifice has a curvilinear configuration.

7. The image-forming machine according to claim 6, where the at least one orifice has a circular configuration with a diameter of about 0.01 inches.

8. An image forming machine comprising:

a photoconductor;

at least one charger operatively connected to the photoconductor, the at least one charger to electrostatically charge the photoconductor;

an exposure machine operatively connected to the photoconductor, the exposure machine to form an electrostatic image on the photoconductor; and a development station operatively connected to the photoconductor, the development station comprising a dusting control system, the development station to apply toner on the photoconductor within a development region, the dusting control system to generate a flow barrier adjacent to the development region;

where the dusting control system comprises a conduit connected to at least one airflow device, the conduit forming at least one orifice and forming at least one plenum;

where the at least one orifice has a cross-section area in the range of about 0.03 square inches through about 0.04 square inches.

9. An image forming machine comprising:

a photoconductor;

at least one charger operatively connected to the photoconductor, the at least one charger to electrostatically charge the photoconductor;

an exposure machine operatively connected to the photoconductor, the exposure machine to form an electrostatic image on the photoconductor; and a development station operatively connected to the photoconductor, the development station comprising a dusting control system, the development station to apply toner on the photoconductor within a development region, the dusting control system to generate a flow barrier adjacent to the development region;

where the flow barrier extends from the development station to a predetermined distance from the photoconductor;

where the predetermined distance is about zero.

10. An image forming machine comprising:

a photoconductor;

at least one charger operatively connected to the photoconductor, the at least one charger to electrostatically charge the photoconductor;

an exposure machine operatively connected to the photoconductor, the exposure machine to form an electrostatic image on the photoconductor; and a development station operatively connected to the photoconductor, the development station comprising a dusting control system, the development station to apply toner on the photoconductor within a development region, the dusting control system to generate a flow barrier adjacent to the development region;

where the flow barrier extends from the development station to a predetermined distance from the photoconductor;

where the predetermined distance is less than about a thickness of an image on the photoconductor.

11. An image forming machine comprising:

a photoconductor;

at least one charger operatively connected to the photoconductor, the at least one charger to electrostatically charge the photoconductor;

an exposure machine operatively connected to the photoconductor, the exposure machine to form an electrostatic image on the photoconductor; and a development station operatively connected to the photoconductor, the development station comprising a dusting control system, the development station to apply toner on the photoconductor within a development region, the dusting control system to generate a flow barrier adjacent to the development region;

where the flow barrier surrounds the development region.

12. An image-forming machine comprising:

a photoconductor: and a development station operatively connected to the photoconductor, the development station comprising a dusting control system and a leading edge, the development station to apply toner on the photoconductor, the dusting control system to generate a flow barrier adjacent to at least a portion of the leading edge;

where the flow barrier essentially surrounds a development region on the development station.

13. An image-forming machine comprising:

a photoconductor: and a development station operatively connected to the photoconductor, the development station comprising a dusting control system and a leading edge, the development station to apply toner on the photoconductor, the dusting control system to generate a flow barrier adjacent to at least a portion of the leading edge;

where the flow barrier extends from the development station to a predetermined distance from the photoconductor;

where the predetermined distance is about zero.

14. An image-forming machine comprising:

a photoconductor: and a development station operatively connected to the photoconductor, the development station comprising a dusting control system and a leading edge, the development station to apply toner on the photoconductor, the dusting control system to generate a flow barrier adjacent to at least a portion of the leading edge;

where the flow barrier is responsive to the static profile of the development station.

15. An image-forming machine comprising:

a photoconductor: and a development station operatively connected to the photoconductor, the development station comprising a dusting control system and a leading edge, the development station to apply toner on the photoconductor, the dusting control system to generate a flow barrier adjacent to at least a portion of the leading edge;

where the dusting control system comprises a conduit forming at least one orifice and forming at least one plenum;

where the at least one orifice has a cross-section area in the range of about 0.03 square inches through about 0.04 square inches.

16. An image-forming machine comprising:

a photoconductor: and a development station operatively connected to the photoconductor, the development station comprising a dusting control system and a leading edge, the development station to apply toner on the photoconductor, the dusting control system to generate a flow barrier adjacent to at least a portion of the leading edge;

where the dusting control system comprises a conduit forming at least one orifice and forming at least one plenum;

where the conduit has an essentially straight configuration parallel to the leading edge.

17. A development station for an image-forming machine comprising:

a dusting control system that spans at least a portion of a leading edge, the dusting control system to generate a flow barrier adjacent to a development region;

where the flow barrier essentially surrounds the development region.

18. An image-forming machine comprising:

a photoconductor: and a development station operatively connected to the photoconductor, the development station comprising a dusting control system and a leading edge, the development station to apply toner on the photoconductor, the dusting control system to generate a flow barrier adjacent to at least a portion of the leading edge;

where the dusting control system comprises a conduit forming at least one orifice and forming at least one plenum;

where the conduit is inserted into a surface of the developer station.

19. An image-forming machine comprising:

a photoconductor: and a development station operatively connected to the photoconductor, the development station comprising a dusting control system and a leading edge, the development station to apply toner on the photoconductor, the dusting control system to generate a flow barrier adjacent to at least a portion of the leading edge;

where the dusting control system comprises a conduit forming at least one orifice and forming at least one plenum;

where the at least one orifice has a curvilinear configuration.

* * * * *